US007699115B2

(12) United States Patent
Baaijens et al.

(10) Patent No.: US 7,699,115 B2
(45) Date of Patent: Apr. 20, 2010

(54) METHOD FOR APPLYING AN ANNULAR SEAL TO A TUBULAR ELEMENT

(75) Inventors: Matheus Norbertus Baaijens, Rijswijk (NL); Martin Gerard Bosma, Rijswijk (NL); Erik Kerst Cornelissen, Rijswijk (NL)

(73) Assignee: Shell Oil Company, Houston, TX (US)

( * ) Notice: Subject to any disclaimer, the term of this patent is extended or adjusted under 35 U.S.C. 154(b) by 484 days.

(21) Appl. No.: 10/592,407

(22) PCT Filed: Mar. 9, 2005

(86) PCT No.: PCT/EP2005/051040

§ 371 (c)(1),
(2), (4) Date: Sep. 11, 2006

(87) PCT Pub. No.: WO2005/090741

PCT Pub. Date: Sep. 29, 2005

(65) Prior Publication Data

US 2007/0205002 A1 Sep. 6, 2007

(30) Foreign Application Priority Data

Mar. 11, 2004 (EP) ..... 04251397

(51) Int. Cl.
*E21B 33/12* (2006.01)
*E21B 33/14* (2006.01)

(52) U.S. Cl. ..... 166/387; 166/179; 166/191

(58) Field of Classification Search ..... 166/387, 166/179, 118, 180, 191, 121, 125
See application file for complete search history.

(56) References Cited

U.S. PATENT DOCUMENTS

| | | | | |
|---|---|---|---|---|
| 1,525,582 | A * | 2/1925 | Hosmer | 277/329 |
| 3,385,367 | A | 5/1968 | Kolisman | 166/191 |
| 3,918,523 | A * | 11/1975 | Stuber | 166/285 |
| 5,964,292 | A * | 10/1999 | Hewitt | 166/292 |
| 7,059,415 | B2 * | 6/2006 | Bosma et al. | 166/313 |

FOREIGN PATENT DOCUMENTS

WO 2003008756 1/2003

OTHER PUBLICATIONS

International Search Report of PCT/EP2005/051040 dated May 24, 2005.

* cited by examiner

*Primary Examiner*—David J Bagnell
*Assistant Examiner*—David Andrews

(57) ABSTRACT

A method is provided of applying an annular seal to a tubular element (7) for use in a wellbore (1). The method comprises the steps of: a) providing at least one flexible seal layer (20) at the wellbore site, each seal layer having a pair of opposite longitudinal edges movable relative to each other between an open position wherein the seal layer can be radially applied to the tubular element, and a closed position wherein the seal layer extends substantially around the tubular element, the seal layer being made material susceptible of swelling upon contact with a selected fluid; b) partially lowering the tubular element (7) into the wellbore (1); c) radially applying the seal layer (20) in the open position thereof to a portion of the tubular element extending above the wellbore; d) moving the seal layer (20) to the closed position thereof; and e) further lowering the tubular element (7) with the seal layer (20) applied thereto into the wellbore (1) until the seal layer is located at a selected location in the wellbore (1).

8 Claims, 3 Drawing Sheets

METHOD FOR APPLYING AN ANNULAR SEAL TO A TUBULAR ELEMENT

PRIORITY CLAIM

The present application claims priority on European Patent Application 04251397.8 filed 11 Mar. 2004.

FIELD OF THE INVENTION

The present inventions relate to a method of providing an annular seal to a tubular element for use in a wellbore.

BACKGROUND OF THE INVENTION

In the field of hydrocarbon fluid production from a wellbore it is generally required to seal the annular space between a production conduit extending into the wellbore and a surrounding casing or liner, or between the wellbore wall and the casing or liner. Various types of packers have been applied to provide such sealing functionality. Conventional packers generally are pre-fitted to tubular element sections, often referred to as "subs", which are to be included in the tubular element. Thus in assembling the tubular element it will be required to incorporate the tubular sections to which the packers are pre-fitted, into the tubular element at selected locations in accordance with the wellbore depth where such packers are to be finally installed. However it has been experienced that the number of required packers, and the depths where these are to be installed, may not become apparent until during assembly and installation of the tubular element into the wellbore. Once the tubular element (or a portion thereof) has been assembled there is a reduced flexibility in setting the packers at the desired wellbore depths. Furthermore, pre-fitted packers generally need to be assembled to the respective tubular sub in a dedicated workshop remote from the wellbore site. Such remote assembly may further reduce the flexibility in applying packers to the tubular element during assembly thereof at the wellbore site, in view of the required logistics.

SUMMARY OF THE INVENTION

The inventions provides a method of applying an annular seal to a tubular element for use in a wellbore, the method comprising:

a) providing at least one flexible seal layer at the wellbore site, each seal layer having a pair of opposite longitudinal edges movable relative to each other between an open position wherein the seal layer can be radially applied to the tubular element, and a closed position wherein the seal layer extends substantially around the tubular element, the seal layer being made of a material susceptible of swelling upon contact with a selected fluid;

b) partially lowering the tubular element into the wellbore;

c) radially applying the seal layer in the open position thereof to a portion of the tubular element extending above the wellbore;

d) moving the seal layer to the closed position thereof; and e) further lowering the tubular element with the seal layer applied thereto into the wellbore until the seal layer is located at a selected location in the wellbore.

BRIEF DESCRIPTION OF THE DRAWINGS

The inventions will be described in more detail hereinafter by way of example, with reference to the accompanying drawings in which.

In the drawings like reference numerals relate to like components.

DETAILED DESCRIPTION OF THE INVENTION

Figure 1:
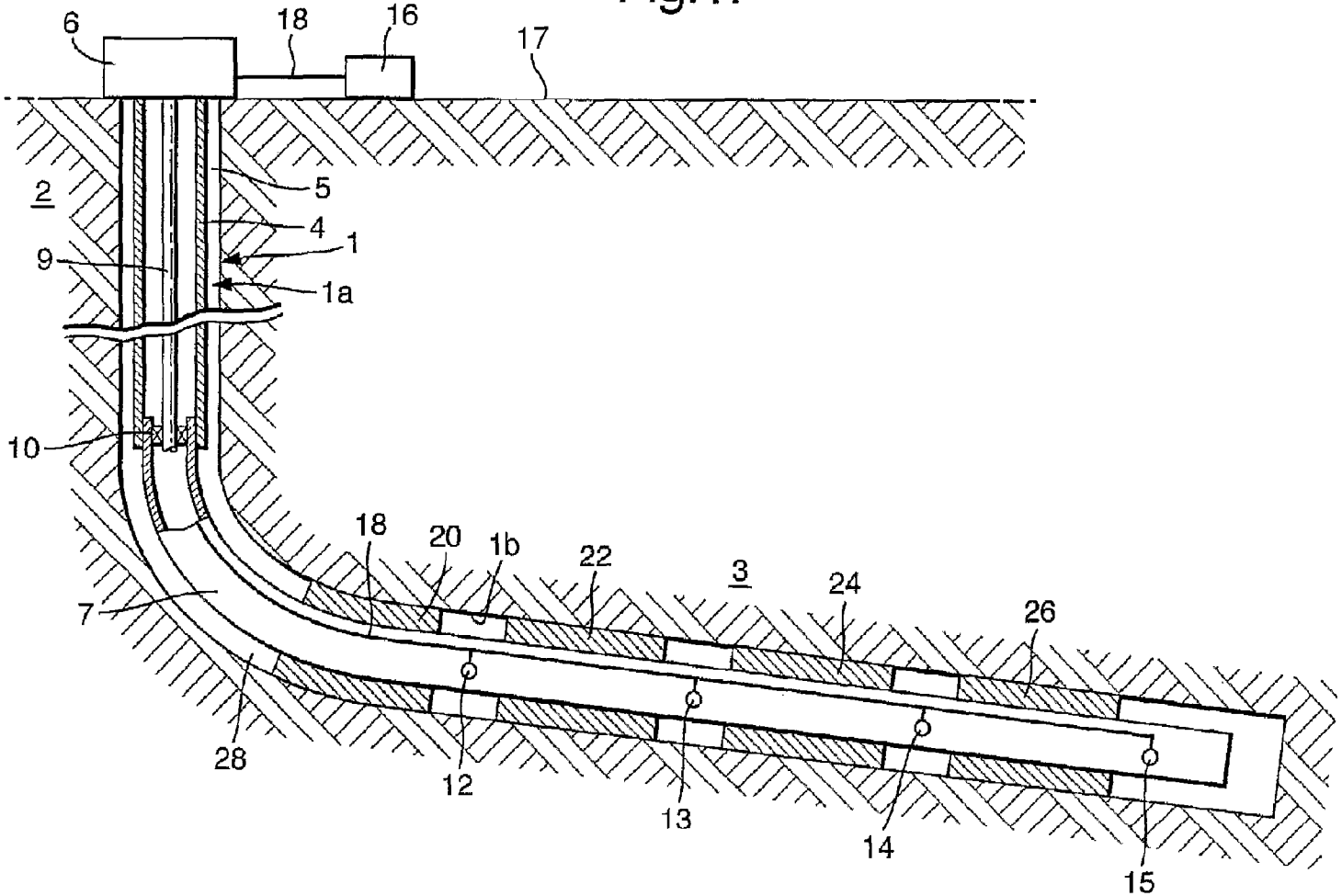
FIG. 1 schematically shows a wellbore in which an embodiment of a conduit and seal layer used in the method of the invention is applied.

Referring to FIG. 1 there is shown a wellbore 1 formed in an earth formation 2 for the production of hydrocarbon fluid, the wellbore 1 having a substantially vertical upper section 1*a* and a substantially horizontal lower section 1*b* extending into a zone 3 of the earth formation from which hydrocarbon fluid is to be produced. The earth formation zone 3 is fractured whereby there is a risk that water from other formation zones (not shown) enters the lower wellbore section 1*b* via fractures in formation zone 3. The upper wellbore section 1*a* is provided with a casing 4 cemented in the wellbore by a layer of cement 5, and a wellhead 6 is arranged on top of the wellbore 1 at surface 17. A production liner 7 extends from the lower end part of the casing 4 into the substantially horizontal wellbore section 1*b*. A production tubing 9 provides fluid communication between the wellhead 6 and the production liner 7, the production tubing 9 being suitably sealed to the production liner 7 by packer 10.

The production liner 7 is provided with a plurality of inflow control devices in the form of inflow control valves 12, 13, 14, 15 spaced along the length of the liner 7. Each inflow control valve 12, 13, 14, 15 is electrically connected to a control center 16 at surface via a set of control lines 18 extending along the outer surface of the production liner 7 and the inner surface of the casing 4, so as to allow each inflow control valve 12, 13, 14, 15 to be opened or closed from the control center 16.

A plurality of seal layers 20, 22, 24, 26 is arranged in the annular space 28 between the production liner 7 and the wall of wellbore section 1*b*, wherein the seal layers 20, 22, 24, 26 and the inflow control valves 12, 13, 14, 15 are arranged in alternating order along the production liner 7. Each seal layer 20, 22, 24, 26 includes a material susceptible of swelling upon contact with water from a water-bearing layer of the earth formation 2, such material preferably being HNBR elastomer.

Figure 2B:
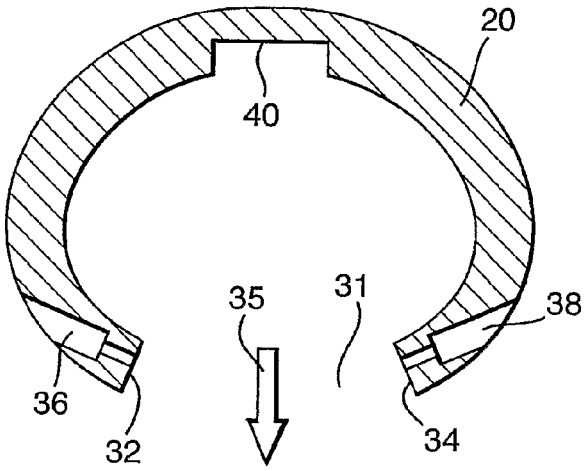
FIG. 2B schematically shows the seal layer before application to the conduit.
Figure 3:
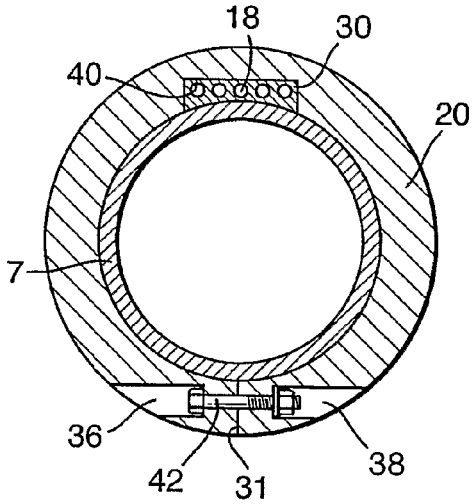
FIG. 3 schematically shows a longitudinal section of the seal layer when applied to the conduit.
Figure 2A:
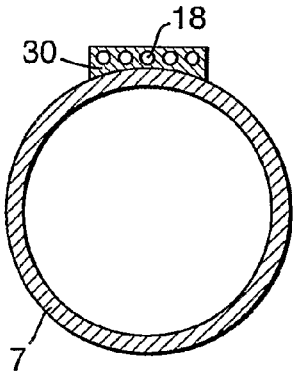
FIG. 2A schematically shows a cross-sectional view of the conduit of FIG. 1.

Referring to FIGS. 2A and 2B there is shown a cross-section of the production liner 7 and the seal layer 20 before application of the seal layer to the production liner 7. The set of control lines 18 is enclosed by a cover member 30 which is fastened to the outer surface of the production liner 7 by suitable fastening means (not shown). The seal layer 20 has a longitudinal slit 31 defining a pair of opposite longitudinal edges 32, 34 allowing the seal layer 20 to be movable between an open position (as shown in FIG. 2) in which said edges 32, 34 are displaced from each other so as to allow the seal layer 20 to be radially applied in the direction of arrow 35 to the production liner 7, and a closed position (as shown in FIG. 3) in which said edges 32, 34 are located adjacent each other so as to allow the seal layer 20 to substantially enclose the production liner 7. Furthermore, the seal layer 20 is provided with pairs of bores 36, 38 spaced at regular longitudinal distances along the seal layer 20. The bores 36, 38 of each pair are formed at the respective longitudinal edges 32, 34, and are formed so as to allow a bolt (referred to hereinafter) to be extended through the aligned bores 36, 38 in order to fasten the seal layer 20 to the production liner 7. The seal layer 20 is provided with a longitudinal recess 40 formed at the inner surface thereof for accommodating the set of control lines 18 and the cover member 30.

In FIG. 3 are shown the production liner 7 and the seal layer 20 after the seal layer 20 has been radially applied to the production liner 7 so as to enclose the production liner 7. The seal layer 20 is clamped to the conduit by a plurality of bolt/nut assemblies 42, each bolt/nut assembly 42 extending through a corresponding pair of the bores 36, 38.

Figure 4:
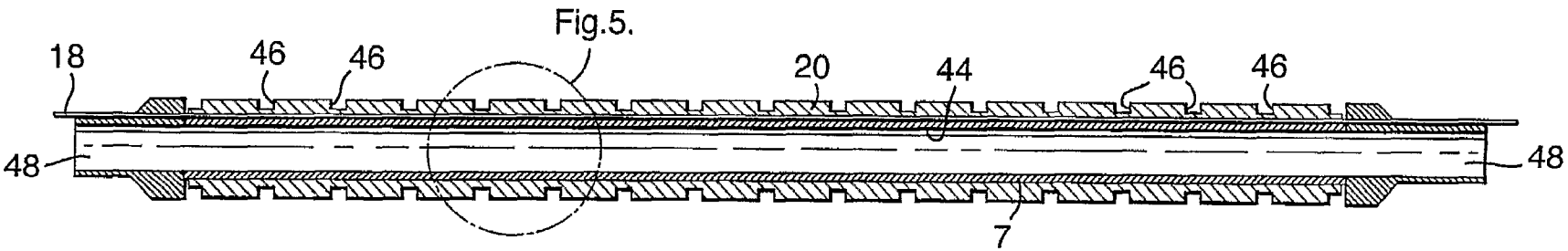
FIG. 4 schematically shows a longitudinal section of seal layer when applied to the conduit.
Figure 5:
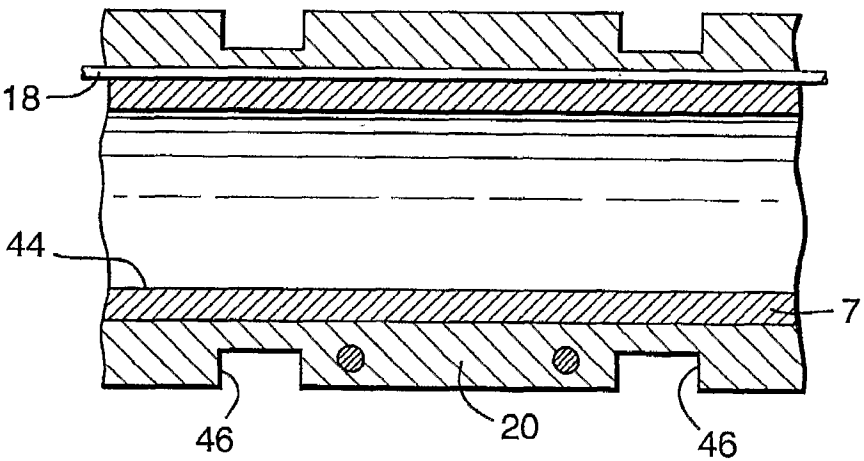
FIG. 5 schematically shows detail A of FIG. 4.

Referring to FIGS. 4 and 5 there is shown the seal layer 20 and the production liner 7 in longitudinal section. The production liner 7 is assembled from a number of tubular joints 44 having a standard length of about 10 m (30 ft), whereby each seal layer 20, 22, 24, 26 extends substantially the full length of the respective tubular joint 44 to which the seal layer 20 is applied. Each such joint 44 is provided with respective connector portions 48 at opposite ends thereof for interconnecting the various joints 44. The outer surface of the annular seal layer 20 is provided with a plurality of annular recesses 46 regularly spaced along the length of the seal layer 20.

During normal operation, the production liner 7 is assembled from the respective tubular joints 44 and from respective short sections of tubular element (termed "subs"; not shown) which include the respective control valves 12, 13, 14, 15. Assembly occurs at the well site in progression with lowering of the production liner 7 into the wellbore 1. The set of control lines 18 together with the cover member 30 is fed to the production liner 7, and fixedly connected thereto, simultaneously with lowering of the production liner 7 into the wellbore 1. Each seal layer 20, 22, 24, 26 is then radially applied to the production liner 7 at the desired location thereof in a manner that the recess 40 encloses the cover member 30 (and hence the control lines 18). The seal layer 20 is then moved to its closed position so as to enclose the tubular joint 44, and fixed to the tubular joint 20 by fastening the bolt/nut assemblies 42 extending through the respective pairs of bores 36, 38. The other seal layers 22, 24, 26 are assembled to the respective tubular joints 44 in a similar manner. The production liner 7 is installed in the wellbore 1 such that the seal layers 20, 22, 24, 26 and the inflow control valves 12, 13, 14, 15 are located in the earth formation zone 3 containing hydrocarbon fluid.

After the wellbore 1 has been suitably completed, hydrocarbon fluid is allowed to flow from earth formation zone 3 into the wellbore section 1*a* and from there via the inflow control valves 12, 13, 14, 15 into the production liner 7 and the production tubing 9. In the event that formation water enters the annular space between the production liner 7 and the wellbore wall, one or more of the seal layers 20, 22, 24, 26 which become into contact with the formation water will swell until further swelling is prevented by the wellbore wall. The annular recesses 46 enlarge the contact area of the seal layers with formation water, thereby promoting swelling of the seal layers. Once the swollen seal layers 20, 22, 24, 26 become compressed between the production liner 7 and the wellbore wall, further migration of the formation water through the annular space is prevented. In order to determine the location, of water inflow, a test is carried by successively opening and/or closing the inflow control valves 12, 13, 14, 15 and simultaneously measuring the inflow of formation water. The location of inflow is determined from an observed reduced (or eliminated) inflow of formation water as a result of closing of one or more specific inflow control valves 12, 13, 14, 15. Once the location of water inflow has been determined, one or more of the inflow control valve(s) 12, 13, 14, 15 at the location of inflow are closed so that inflow of formation water into the production liner 7 is thereby eliminated.

Swelling of each seal layer 20, 22, 24, 26 also results in adequate sealing of the seal layer against the production liner 7 and the cover member 30 so as to prevent fluid migration between the seal layer and the production liner or the cover member 30.

Instead of allowing the seal layer to swell by virtue of contact with water from the earth formation, such swelling can be triggered by bringing the seal layer into contact with water-base wellbore fluid pumped into the wellbore.

Furthermore, the seal layer can be made of a material susceptible of swelling upon contact with hydrocarbon fluid, such as crude oil or diesel. In such application the seal layer can be induced to swell upon contact with hydrocarbon fluid from the wellbore, or upon contact with hydrocarbon fluid pumped into the wellbore.

Also, a hybrid system can be applied including seal layer sections susceptible of swelling upon contact with hydrocarbon fluid, and seal layer sections susceptible of swelling upon contact with water from the earth formation.

Instead of the seal layer being allowed to swell by virtue of contact with water or oil from the earth formation, the seal layer can be triggered to swell by pumping the selected fluid, for example diesel fluid, into the wellbore. Such procedure has the advantage of preventing premature swelling during lowering of the tubular element into the wellbore.

With the method of the inventions it is achieved that during assembly and lowering of the tubular element into the wellbore, the seal layer can be applied to an already assembled portion of the tubular element. Thus there is enhanced flexibility in selecting locations along the tubular element where the seal layer(s) can be applied to the tubular element. Furthermore, with the method of the invention assembly of the tubular element from tubular joints becomes independent from the availability of pre-fitted packers at the well site. Also it is achieved that logistic problems due to remote assembly of the packers to the respective tubular sub, are avoided.

Suitably step a) includes providing a plurality of said seal layers at the site of the wellbore, and step c) includes radially applying the seal layers to the tubular element at mutually spaced locations along the tubular element.

Preferably each seal layer is made of a material susceptible of swelling upon contact with hydrocarbon fluid or water, for example water from the earth formation.

To increase the area of contact with the selected fluid, suitably the seal layer is provided with a plurality of annular recesses at the outer surface of the seal layer.

In case the seal layer is to be arranged in an annular space between the wellbore wall and a wellbore casing or liner, it is preferred that the seal layer is made as long as possible in order to avoid bypassing of fluid through the rock formation opposite the seal layer. In practical applications it is therefore preferred that that the length of the seal layer corresponds to substantially the length of the tubular element section (i.e. the tubular joint) to which the seal layer is applied, minus the lengths of the respective connectors of the tubular joint. To facilitate easy handling and applying of the seal at the drill rig floor, it is preferred that the seal layer is formed of a plurality of seal layer sections arranged adjacent each other. Such sections typically have a length of between 0.5-2.0 meter, for example about 1 meter.

We claim:

1. A method of applying an annular seal to a tubular element for use in a wellbore, the method comprising:

a) providing at least one flexible seal layer at the wellbore site, each seal layer having a pair of opposite longitudinal edges movable relative to each other between an open position wherein the seal layer can be radially applied to the tubular element, and a closed position wherein the seal layer extends substantially around the tubular element, the seal layer being made of material susceptible of swelling upon contact with a selected fluid; wherein the tubular element is assembled from a plurality of tubular element sections, and wherein the length of each seal layer corresponds to substantially the length of the tubular element section to which the seal layer is applied; wherein the seal layer includes at least two pairs of aligned bores longitudinally spaced apart along the seal layer; wherein the aligned bores in each pair are formed so as to allow a bolt to be extended through the aligned bores so as to fasten the seal layer; and wherein the seal layer is provided with a longitudinal recess for accommodating a set of control lines;

b) partially lowering the tubular element into the wellbore;

c) applying the seal layer in the open position thereof to a portion of the tubular element extending above the wellbore;

d) moving the seal layer to the closed position thereof and fastening the seal layer by extending a bolt through each pair of aligned bores and affixing a nut to each bolt; and e) further lowering the tubular element with the seal layer applied thereto into the wellbore until the seal layer is located at a selected location in the wellbore.

2. The method of claim 1, wherein step a) comprises providing a plurality of said seal layers at the wellbore site, and wherein step c) includes radially applying the seal layers to the tubular element at mutually spaced locations along the tubular element.

3. The method of claim 2, wherein each seal layer is made of a material susceptible of swelling upon contact with water or hydrocarbon fluid.

4. The method of claim 3, wherein the seal layer comprises an elastomer material susceptible of swelling upon contact with water in the wellbore.

5. The method of claim 4, wherein the seal layer comprises Hydrogenated Nitrile Butadiene Rubber (HNBR) elastomer.

6. The method of claim 1, wherein the seal layer is provided with a plurality of annular recesses at the outer surface of the seal layer.

7. The method of claim 1, wherein each seal layer is formed of a plurality of seal layer sections arranged adjacent each other.

8. The method of claim 1, wherein each seal layer is adapted to seal an annular space formed between the tubular element and the wall of the wellbore.

* * * * *